US005757325A

United States Patent [19]

Saldell

[11] Patent Number: 5,757,325

[45] Date of Patent: May 26, 1998

[54] ANTENNA DEVICE FOR PORTABLE EQUIPMENT

[75] Inventor: Ulf Saldell, Österskär, Sweden

[73] Assignee: Allgon AB, Akersberga, Sweden

[21] Appl. No.: 331,530

[22] PCT Filed: Oct. 27, 1993

[86] PCT No.: PCT/SE93/00886

§ 371 Date: May 24, 1995

§ 102(e) Date: May 24, 1995

[87] PCT Pub. No.: WO94/10720

PCT Pub. Date: May 11, 1994

[30] Foreign Application Priority Data

Oct. 29, 1992 [SE] Sweden ..... 9203199

[51] Int. Cl.[6] ..... H01Q 1/24

[52] U.S. Cl. ..... 343/702; 343/895; 343/901

[58] Field of Search ..... 343/702, 715, 343/745, 749, 860, 900, 901, 902; H01Q 1/24

[56] References Cited

U.S. PATENT DOCUMENTS

| | | | |
|---|---|---|---|
| 4,121,218 | 10/1978 | Irwin et al. | 343/702 |
| 4,725,845 | 2/1988 | Phillips | 343/702 |
| 4,868,576 | 9/1989 | Johnson, Jr. | 343/702 |
| 5,204,687 | 4/1993 | Elliott et al. | 343/702 |
| 5,317,325 | 5/1994 | Bottomley | 343/702 |
| 5,446,469 | 8/1995 | Makino | 343/702 |
| 5,469,177 | 11/1995 | Rush et al. | 343/702 |
| 5,594,459 | 1/1997 | Hirota | 343/749 |
| 5,650,789 | 7/1997 | Elliott et al. | 343/702 |

FOREIGN PATENT DOCUMENTS

| | | |
|---|---|---|
| 0511577A2 | 11/1992 | European Pat. Off. . |
| 2253949A | 9/1992 | United Kingdom . |

*Primary Examiner*—Donald T. Hajec
*Assistant Examiner*—Tan Ho
*Attorney, Agent, or Firm*—Jacobson, Price, Holman & Stern, PLLC

[57] ABSTRACT

The antenna device of the present invention is intended for a portable equipment for transmitting and/or receiving radio signals. Said antenna device comprises a helical antenna substantially having the characteristics of a half-wave antenna, a half-wave antenna, and an impedance transformer. Said helical antenna, said half-wave antenna, and said impedance transformer are intercouplable so that either said helical antenna alone is coupled to said impedance transformer or said helical antenna and said half-wave antenna are coupled in parallel to said impedance transformer in order to form two different working functions.

20 Claims, 4 Drawing Sheets

ANTENNA DEVICE FOR PORTABLE EQUIPMENT

FIELD OF THE INVENTION

The invention relates to an antenna device for portable equipment, particularly for hand portable telephones.

BACKGROUND OF THE INVENTION

Antennas for mobile telephones may be divided into two main groups, quarter-wave and half-wave antennas, although types somewhere between and outside these may occur.

Characteristics of a quarter-wave antenna are:

- the length of its actively radiating portion is one quarter of a wavelength (portion length approximately 8 cm at 900 MHz),
- its feeding connection impedance is low, which allows its direct connection to the 50 ohm of the telephone, without impedance transformation,
- due to its short length a 900 MHz telephone user will not consider it disturbing,
- it is dependent on a ground plane for its function.

Characteristics of a half-wave length antenna are:

- the length of its actively radiating portion is one half of a wavelength (portion length approximately 16 cm at 900 MHz),
- its feeding connection impedance is high, which requires impedance transformation to the 50 Ohm of the telephone,
- it is unsuitable to small telephone due to its total length of 18–20 cm including a connector,
- it is independent of a ground plane for its function.

In the specification and claims below the terms half-wave antenna and quarter-wave antenna refer to antennas having substantially the above characteristics, respectively.

One disadvantage in using the quarter-wave antenna, which is dependent on a ground plane, is that the ground plane offered in hand portable telephone is in most cases smaller than one wavelength in a radius from the feeding point of the antenna. As a result, the ground plane becomes resonant and, consequently, it must be tuned to the antenna for optimal performance. Moreover, the ground plane characteristics change (and so the antenna performance) depending on whether the telephone is placed freely, whether the telephone (the ground plane) is held with the hand, whether the user is perspiring, whether the telephone is moved to the ear etc.

Another disadvantage in using a quarter-wave antenna for a hand portable telephone is, in fact, its small length. This causes the antenna, while in call position, to be strongly screened in a substantial angle sector by the head of the user.

In spite of the above mentioned disadvantages, the most common antenna for hand portable telephones is a quarter-wave length antenna, since a small antenna is needed to regard the telephone as hand portable or a pocket telephone. Recently, a type of hand portable telephone has appeared, which are provided with extendable half-wave antennas. This is an acceptable solution from the handling point of view, since the antenna requires a small space in the retracted position. The problem in this case is that the antenna function is so poor in the retracted position that it might be difficult to receive an incoming call.

Another known type of mobile telephones employs in combination a considerably more compact helical antenna of quarter-wave type as an antenna for receiving an incoming call, and a half-wave antenna which is extended in call position. However, this arrangement is unsatisfactory due to the ground plane dependence of the helical antenna and the switching between the helical antenna and the half-wave antenna being complicated, since only one antenna at the time may connected. Also, a helical antenna has a lower degree of efficiency than e.g. a rod antenna.

All the above mentioned disadvantages are overcome by an antenna device according to the present invention.

SUMMARY OF THE INVENTION

This new antenna device for portable equipment uses in combination a helical antenna of half-wave length type arranged outside of a main body of said portable equipment, an extendable half-wave antenna, and an impedance transformer. Therefore, no ground plane is required for the antenna function. Further, due to the sufficient length of the half-wave length antenna, the problem of the user's head screening the antenna is substantially reduced. Yet further, a very simple switching may be performed, since the helical antenna and half-wave length antenna may utilize the same impedance transformer. The half-wave length antenna, when in use, may even be connected parallel to the helical antenna due to impedance differences. According to the invention this possibility is utilized and, therefore, only a very simple switching device is required. The switching device may be operated by extending and retracting of the antenna.

In the retracted position (see FIG. 3*a*) the half-wave length antenna is neither galvanically nor capacitively coupled to the impedance transformer. In this position the antenna function consists of only the helical antenna, which is constantly coupled to the impedance transformer. In the retracted position at possible coupling the lower end is transformed with high impedance to the upper end, which minimized the influence.

In the extended position the helical antenna and the half-wave length antenna are connected in parallel to the impedance transformer. Since the impedance of the half-wave length antenna is small compared to the impedance of the helical antenna the antenna function in this position is substantially the same as for a half-wave antenna.

Thus, with the described device one meets the demands of antenna size in order to consider the telephone as hand portable, antenna performance in call position, and the telephone accessibility for incoming calls, when the half-wave antenna is in its retracted position.

It is possible to obtain the above-described characteristics with either galvanical or non-galvanical coupling of RF-signals e.g. between the half-wave antenna and the helical antenna/the impedance transformer or between the helical antenna/the half-wave antenna and the impedance transformer.

BRIEF DESCRIPTION OF THE INVENTION

The invention will be described below in the form of two embodiments with reference to the attached drawings, wherein.

Figure 1:
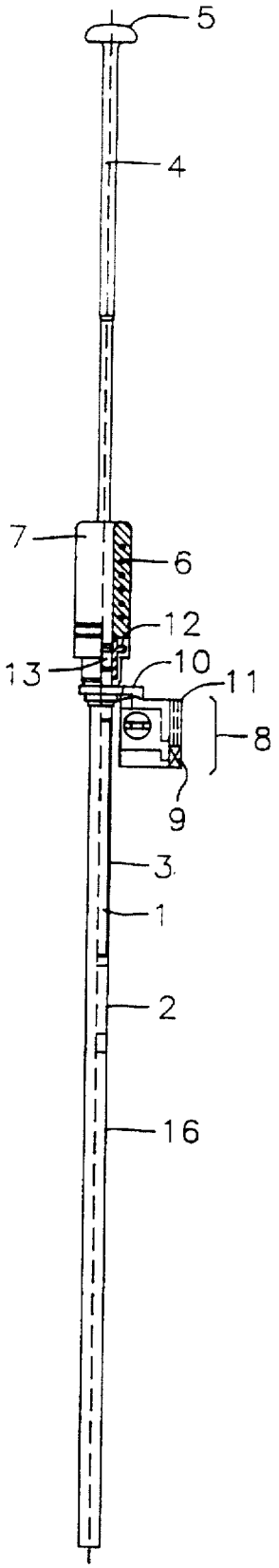
FIG. 1 is a view of an embodiment of the antenna device according to the invention.
Figure 2:
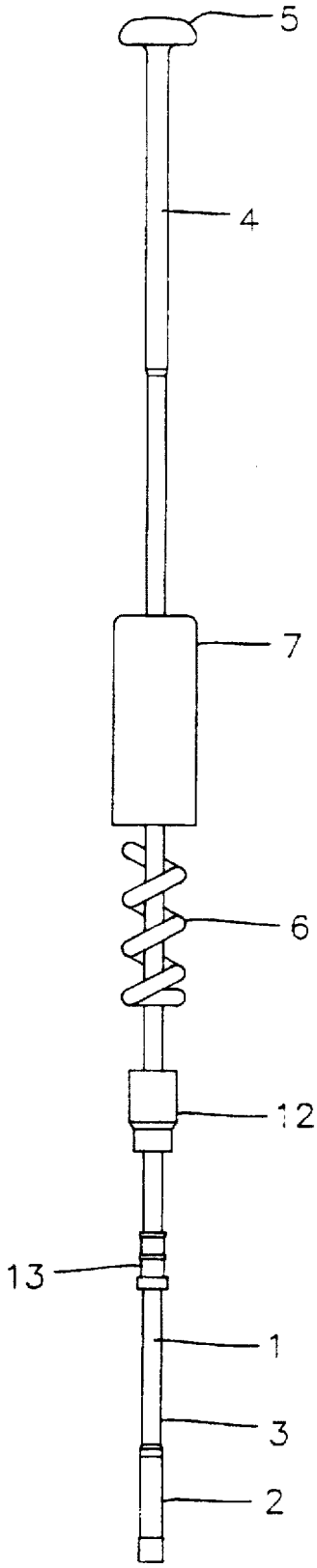
FIG. 2 shows with separated components parts of the antenna device of FIG. 1.
Figure 3A:
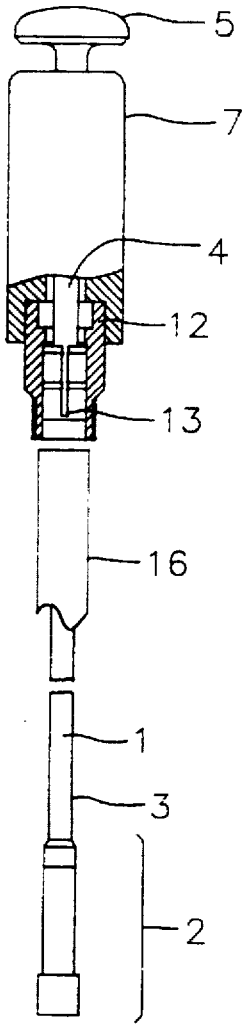

FIG. 3*a* shows details of for instance a switching device of the antenna device of FIG. 1.

Figure 3C:
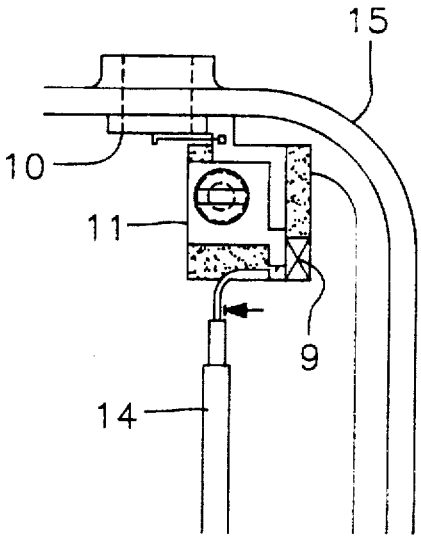
Figure 3B:
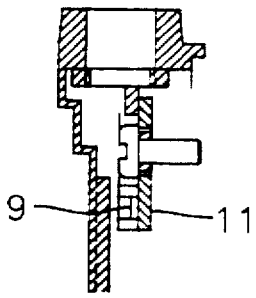

FIG. 3*b*, 3*c* are two views of details of for instance an impedance transformer of the antenna device of FIG. 1.

Figure 4A:
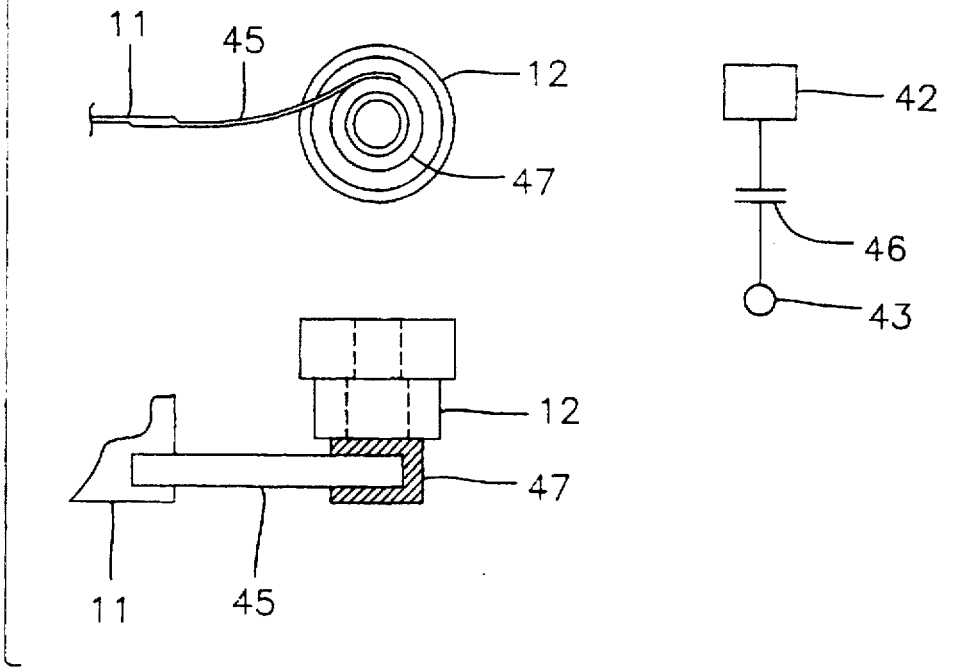
Figure 4B:
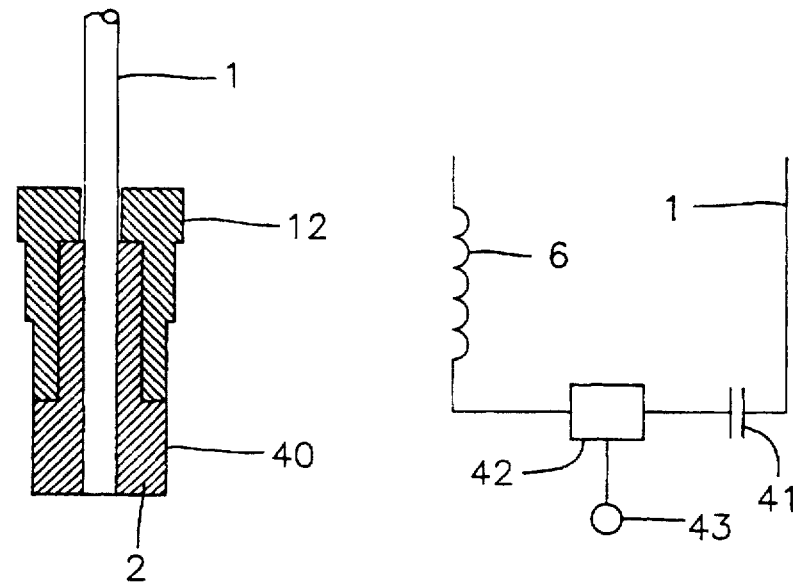

FIG. 4*a*, 4*b* show alternative ways of providing couplings between a helical antenna, a half-wave antenna, and an impedance transformer contained in an antenna device according to the present invention.

DETAILED DESCRIPTION OF THE INVENTION

The antenna device according to a preferred embodiment, shown in FIGS. 1, 2, 3*a*, and 3*b*, consists of three main components.

First a half-wave antenna 1 (rod antenna), the lower end 2 of which is bare to facilitate the galvanic coupling, while it is otherwise provided with an insulating case 3, and the upper end of which is attached to an upper part 4 made of insulating material. Together the half-wave antenna 1 and the upper part 4 form an antenna rod, which is preferably provided with a knob 5 in its upper insulating end.

Secondly, a helical antenna 6 of half-wave length type, which is moulded into a casing 7 made of protective, insulating material, which in its lower end has a fastened sleeve 12 made of conducting material. The sleeve 12 is mechanically and galvanically coupled to the lower of the helical antenna 6 and contains an elastic contact part 13. The antenna rod 1 is movably arranged through the helical antenna 6, the casing 7, the sleeve 12 and the contact part 13.

The above mentioned parts are substantially symmetrically arranged with regard to the central length axis of the antenna rod.

Thirdly, an impedance transformer 8, which, for example, consists of an inductive component 9 mounted on a circuit board 11, the capacitance of which is tuned to the environment. The impedance transformer is provided with a coaxial cable 14 connected to the transceiver part of the telephone, and with a galvanic coupling to the sleeve 12 through a connection loop 10, the sleeve 12 is also a connection device to the hand portable telephone 15 for the antenna device. Preferably, a protective insulating tube 16 is attached on the underneath side of the sleeve 12, into which tube 16 the antenna rod travels when retracted through the sleeve 12.

It is also possible to couple non-galvanically in any combination RF-signals between the half-wave antenna and the helical antenna/the impedance transformer or between the helical antenna/ the half-wave antenna and the impedance transformer. The performance of the antenna device may be substantially maintained in doing so.

According to the example shown in FIG. 4*a*, a coupling is obtained between the sleeve 12 interconnected to the helical antenna and the impedance transformer arranged on the circuit board 11, by means of a conductive, flexible reed 45 connected to the impedance transformer and being in close contact with the lower part of the sleeve 12, said lower part being provided with a thin insulating layer 47. The coupling in this case is capacitive and the corresponding capacitance is inversely proportional to the thickness of the insulating layer 47 and directly proportional to the permitivity of the layer and to an area defining adjacent areas of the lower part of the sleeve 12 and the flexible reed, respectively. The desired capacitance of the coupling is obtained through an appropriate choice of the mentioned parameters. In the eqivalent circuit diagram the capacitor created according to the above is indicated by 46, the sleeve 12 by a block 42, and a connection to the impedance transformer by the point 43.

In mobile telephones transmitting and receiving takes place as well when no call is going on. In this case the antenna rod is completely retracted, so that its upper, non-conductive part 4 is located inside the helical antenna. When so the half-wave antenna is galvanically and substantially capacitively separated from the helical antenna 6, the latter effecting the total antenna function.

During a call, or when otherwise required with regard to antenna performance, the half-wave antenna is extended, its lower part 2 being galvanically or capacitively coupled, via the contact part 13, in parallel with the helical antenna 6, to the impedance transformer 8. Since the impedance of the half-wave antenna 1 is low compared to the impedance of the helical antenna 6, the antenna function in this case is substantially the same as of a half-wave antenna alone.

Thus, the coupling and decoupling of the half-wave antenna 1 is effected by extending and retracting of the antenna rod 1, respectively. The extension of the antenna rod is limited by lower part 2 of the half-wave antenna being stopped by the contact part 13 and the sleeve 12. The contact part 13 also serves as a mechanical locking mechanism of the antenna rod in its extended position, while its retracting movement is limited by e.g. the knob 5 or a bottom of the insulated tube 16.

According to the example shown in FIG. 4*b*, a coupling may be obtained between the half-wave antenna 1, in its extended position, and the sleeve 12, through providing the lower end 2 of the half-wave antenna 1 with a thin insulating layer 40. The coupling in this case between the half-wave antenna 1 and the sleeve 12 is capacitive. The corresponding capacitance is inversely proportional to the thickness of the insulating layer 40 and directly proportional to the permitivity of the layer and to an area defining adjacent areas of the sleeve 12 and the lower part 2, respectively. Since a high capacitance is desirable for this coupling the parameters are selected accordingly. In the eqivalent circuit diagram the capacitor created according to the above is indicated by 41, the sleeve 12 by a block 42, the helical antenna and the half-wave antenna by the symbols 6 and 1, respectively, and a connection to the impedance transformer by the point 43.

I claim:

1. In an apparatus which includes a helical antenna element disposed on a case of a radio circuit; impedance transforming circuitry connected to said helical antenna element and to said radio circuit; and an antenna element which can be accommodated in or extended outside of said case through said helical antenna element; the improvement comprising said helical antenna element and said antenna element each having a one-half wave length, and connecting means for conductively and directly connecting said impedance transforming circuitry through a conductive coupler to said antenna element when said antenna element is extended so that said helical antenna element and said antenna element are conductively and directly connected in parallel with each other to said impedance transforming circuitry.

2. An apparatus according to claim 1 wherein said antenna element is a rod antenna.

3. An apparatus according to claim 1 wherein said conductive coupler includes a holder conductor portion supporting said helical antenna element, and said antenna element includes a conductive lower end portion, wherein when said antenna element is extended, said conductive lower end portion is engaged with said conductive coupler, said conductive coupler being connected with said radio circuit in said case through said impedance transforming circuitry.

4. An apparatus according to claim 3 further including an insulator covering said antenna element and having an extended portion which projects above an upper end portion of said antenna element.

5. An apparatus according to claim 4 wherein said extended portion is longer than a vertical height of said helical antenna element.

6. An apparatus comprising a helical antenna element disposed on a case of a radio circuit; impedance transforming circuitry connected to said helical antenna element and to said radio circuit; an elongated antenna element which can be supported for movement between a retracted position disposed substantially within said case and an extended position in which a portion extends outside of said case and moveable through said helical antenna element; wherein said helical antenna element and said elongated antenna element are each of one-half wave-length; and means electrically coupling said impedance transforming circuitry to said helical antenna element and respectively effecting and interrupting an electrical coupling of said impedance transforming circuitry to said elongated antenna element when said elongated antenna element is in its extended and retracted positions respectively, said means including a conductive holding means supported on said case and electrically coupled to said impedance transforming circuitry and said helical antenna element, said elongated antenna element being electrically and conductively and directly coupled to said conductive holding means and being free of electrical coupling to said conductive holding means when said elongated antenna element is respectively in said extended and retracted positions.

7. The apparatus as claimed in claim 6 wherein said helical antenna element provides the entire antenna function when said elongated antenna element is in its retracted position.

8. An apparatus according to claim 6 wherein said elongated antenna element includes an elongated insulator encasing said elongated antenna element and wherein said means includes a conductive portion at one end of said elongated antenna element and electrically integral with said elongated antenna element, said conductive portion respectively directly contacting and being axially spaced from said conductive holding means when said elongated antenna element is respectively in said extended and retracted positions.

9. An apparatus according to claim 8 including cooperating means on said conductive holding means and said conductive portion for preventing movement of said elongated antenna element beyond said extended position.

10. An apparatus according to claim 9 wherein said elongated insulator has at an outer end thereof an enlarged portion which is engagable with said case in said retracted portion for preventing movement of said elongated antenna element beyond said retracted position.

11. An apparatus according to claim 6 wherein said elongated antenna element includes a nonconductive end portion extending a predetermined distance outwardly beyond an outer end of said elongated antenna element, wherein said helical antenna element has a length less than said predetermined distance and wherein said end portion is within said helical antenna element when said elongated antenna element is in said retracted position.

12. In an apparatus which includes:

a helical antenna element disposed on a case of a radio circuit;

a matching circuit connected to said helical antenna element and to said radio circuit; and a whip antenna element which can be accommodated in or extended outside of said case through said helical antenna element;

the improvement comprising said helical antenna element and said whip antenna element each having a ½-wave length, and connecting means for conductively and directly connecting said matching circuit through a conductive coupler to said whip antenna element when said whip antenna element is extended, so that said antenna elements are conductively and directly connected in parallel with each other to said matching circuit.

13. An apparatus according to claim 12, wherein said conductive coupler includes a holder conductor supporting said helical antenna element and includes a stopper conductor disposed on a lower end portion of said whip antenna element, wherein when said whip antenna element is extended, said stopper conductor is engaged with said holder conductor, said holder conductor being connected with said radio circuit in said case through said matching circuit.

14. An apparatus according to claim 13, further including an insulator covering said whip antenna element and having an extended portion which projects above an upper end portion of said whip antenna element and which is longer than a vertical height of said helical antenna.

15. An apparatus according to claim 12, further including an insulator covering said whip antenna elements and having an extended portion which projects above an upper end portion of said whip antenna element and which is longer than a vertical height of said helical antenna.

16. An apparatus, comprising: a case, an elongate whip antenna having an elongate conductive whip element of ½-wave length and supported on said case for length-wise movement along an axis relative to said case between a retracted position disposed substantially within said case and an extended position in which a portion thereof projects outwardly from said case, a conductive helical antenna element of ½-wave length supported on said case so as to extend helically around said axis, said whip antenna extending through said helical antenna element, a radio circuit disposed in said case, a matching circuit disposed in said case and electrically coupled to said radio circuit, and means electrically coupling said matching circuit to said helical antenna element, and respectively effecting and interrupting an electrical coupling of said matching circuit to said whip element when said whip antenna is respectively in said extended and retracted positions, said means include a holder conductor supported on said case and electrically coupled to said matching circuit and said helical antenna element, said whip element being electrically and conductively and directly coupled to said holder conductor and being free of electrical coupling to said holder conductor when said whip antenna is respectively in said extended and retracted positions.

17. An apparatus, according to claim 16, wherein said whip antenna includes an elongate insulator having said whip element therein, and wherein said means includes a further conductor mounted on one end of said whip antenna and electrically connected to said whip element, said further conductor respectively directly contacting and being axially spaced from said holder conductor when said whip antenna is respectively in said extended and retracted positions.

18. An apparatus according to claim 17, including cooperating means on said holder conductor and further conductor for preventing movement of said whip antenna beyond said extended position.

19. An apparatus according to claim 18, wherein said insulator has at an outer end thereof an enlarged portion which is engagable with said case in said retracted position for preventing movement of said whip antenna beyond said retracted position.

20. An apparatus according to claim 16, wherein said whip antenna includes a nonconductive end portion extending a predetermined axial distance outwardly beyond an outer end of said whip element, wherein said helical antenna element has a dimension in a direction parallel to said axis which is less than said predetermined axial distance, and wherein said end portion of said whip antenna is substantially axially aligned with said helical antenna element when said whip antenna is in said retracted position.

* * * * *